United States Patent [19]

Marks

[11] 4,364,134

[45] Dec. 21, 1982

[54] BED CONSTRUCTION

[76] Inventor: Robert J. Marks, 3450 SW. 126th Ave., C.B. 152, Miramar, Fla. 33027

[21] Appl. No.: 77,923

[22] Filed: Sep. 24, 1979

[51] Int. Cl.[3] ..... A47C 19/12; A47C 27/15

[52] U.S. Cl. ..... 5/201; 5/200 R; 5/280; 5/285; 5/411; 5/420

[58] Field of Search ..... 5/400, 401, 402, 200 R, 5/451, 452, 201, 411, 417, 420, 131, 280, 285, 286, 12 R, 465; D6/61, 62, 63, 79, 80, 81, 82, 83, 84

[56] References Cited

U.S. PATENT DOCUMENTS

| | | | |
|---|---|---|---|
| Re. 29,611 | 4/1978 | Lawrence | 5/131 |
| D. 243,218 | 2/1977 | Baker | D6/84 |
| D. 244,070 | 4/1977 | Marks | D6/63 |
| 3,414,912 | 12/1968 | Dusey et al. | 5/285 |
| 3,740,774 | 6/1973 | Powell | 5/465 |
| 3,846,857 | 11/1974 | Weinstock | 5/464 |
| 4,081,868 | 4/1978 | Hull | 5/12 R |
| 4,103,375 | 8/1978 | Santo | 5/201 |
| 4,145,781 | 3/1979 | Autrey et al. | 5/451 |

FOREIGN PATENT DOCUMENTS

| | | | |
|---|---|---|---|
| 329425 | 9/1935 | Italy | 5/449 |

*Primary Examiner*—Alexander Grosz
*Attorney, Agent, or Firm*—B. J. Powell

[57] ABSTRACT

A bed construction adapted to be supported on a generally horizontal floor surface including a frame assembly defining a generally vertically extending mattress receiving opening therethrough to the floor surface; a resilient foundation removably received in the mattress receiving opening and supported on the floor surface; and a resilient mattress removably received in the mattress receiving opening in said frame on top of the foundation with the frame assembly confining the foundation and mattress in directions parallel to the floor surface. The frame assembly includes a pair of spaced apart, generally parallel, side frame subassemblies, a head frame subassembly connecting said side frame subassemblies at one end thereof, and a foot frame subassembly connecting said side frame subassemblies at the opposite end thereof with each of the frame assemblies including a pair of spaced apart, generally parallel edge members defining an opening therebetween, and at least one decorative panel removably mounted between the edge members and extending across said opening.

9 Claims, 9 Drawing Figures

BED CONSTRUCTION

BACKGROUND OF THE INVENTION

This invention relates generally to a furniture construction and more particularly to a bed construction.

Beds manufactured today generally have a fixed frame which supports a foundation such as box springs or the like and a mattress above the floor. These beds usually have a fixed design which does not permit the user to significantly change the overall appearance thereof as the room decor is changed. Further, these bed frames generally support the foundation and the mattress above the floor. As a result, these bed frames have to be made sufficiently strong to support the weight of the foundation and mattress as well as the person sleeping thereon. Further, the foundation generally required sufficiently heavy construction to be self-supporting and to carry the weight of the mattress and the person sleeping thereon. As a result, these prior art bed constructions used components which were relatively heavy making both the bed frame and at least the foundation difficult to move. Also, because bed frames are generally adapted to be disassembled for moving and because the foundation and mattress were supported on the bed frame itself, any loose motion in the bed frame was transmitted to the person sleeping thereon as the person moved thereby making the bed construction less comfortable than desired for sleeping.

SUMMARY OF THE INVENTION

These and other problems and disadvantages associated with the prior art are overcome by the invention disclosed herein by providing a bed construction in which the bed frame is not used to support the foundation and mattress above the floor, but rather, uses the floor surface as the primary support of the foundation and mattress. The bed frame extends around and confines the foundation and mattress on the floor surface so that the lateral stability of the bed construction is insured. Further, the bed frame is provided with removable inserts so that the inserts can be changed as the room decor changes to facilitate keeping the bed construction in harmony with the room decor.

The apparatus of the invention includes an open frame assembly with an opposed pair of side frame subassemblies joined at opposite ends by head and foot frame subassemblies so as to define a generally vertically extending mattress receiving opening therethrough with a prescribed size and shape so that when the frame is supported on the floor surface, the mattress receiving opening extends through the frame to the floor surface. A resilient foundation member having a size and shape complementary to the size and shape of the mattress receiving opening in the frame assembly is removably received in the mattress receiving opening and supported on the floor surface. The lateral movement of the foundation member is confined by the frame assembly. A resilient mattress having a size and shape complementary to the size and shape of the mattress receiving opening in the frame is removably received in the mattress receiving opening on top of and supported by the foundation member so that a person sleeping on the bed is resiliently supported on top of the mattress by the combined resiliency of the mattress and the foundation member. The frame assembly extends partly up the sides of the mattress so that the lateral motion of the mattress is also confined by the frame assembly. Because the weight of the person sleeping on the bed is carried by the floor surface rather than the frame assembly, the bed is extremely stable. Also, because the foundation member is supported on the floor surface, no special heavy duty constructin is required for the foundation member since it need not be self-supporting as required by the prior art.

Each of the frame subassemblies includes a pair of spaced apart members defining an insert opening therebetween. Decorative inserts are removably mounted between these spaced apart members so that the inserts can be changed to change the bed frame decor. The inserts are slidably mounted in opposed grooves extending along the length of the spaced apart members.

These and other features and advantages of the invention will become more apparent upon consideration of the following detailed description and accompanying drawings wherein like characters of reference designate corresponding parts throughout the several views and in which:

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Figure 1:
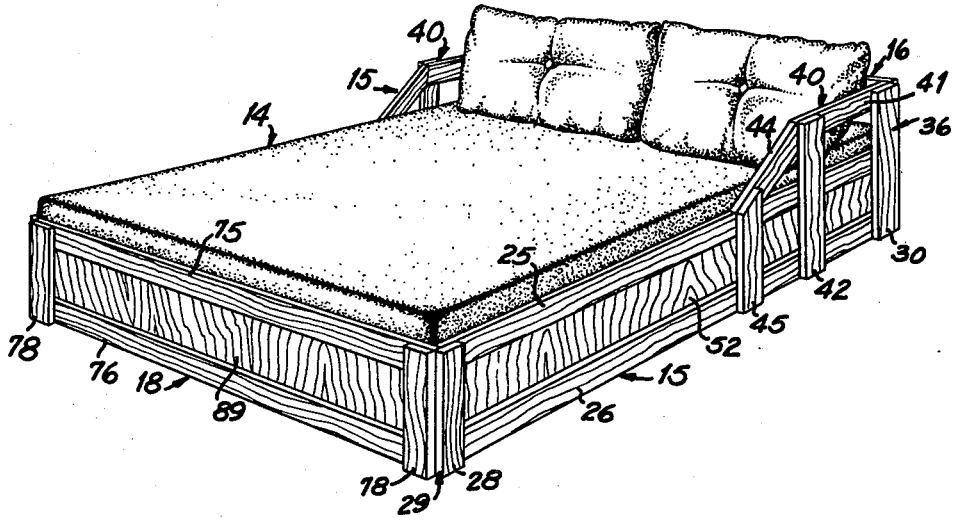
FIG. 1 is a perspective view showing a bed incorporating the invention.
Figure 2:
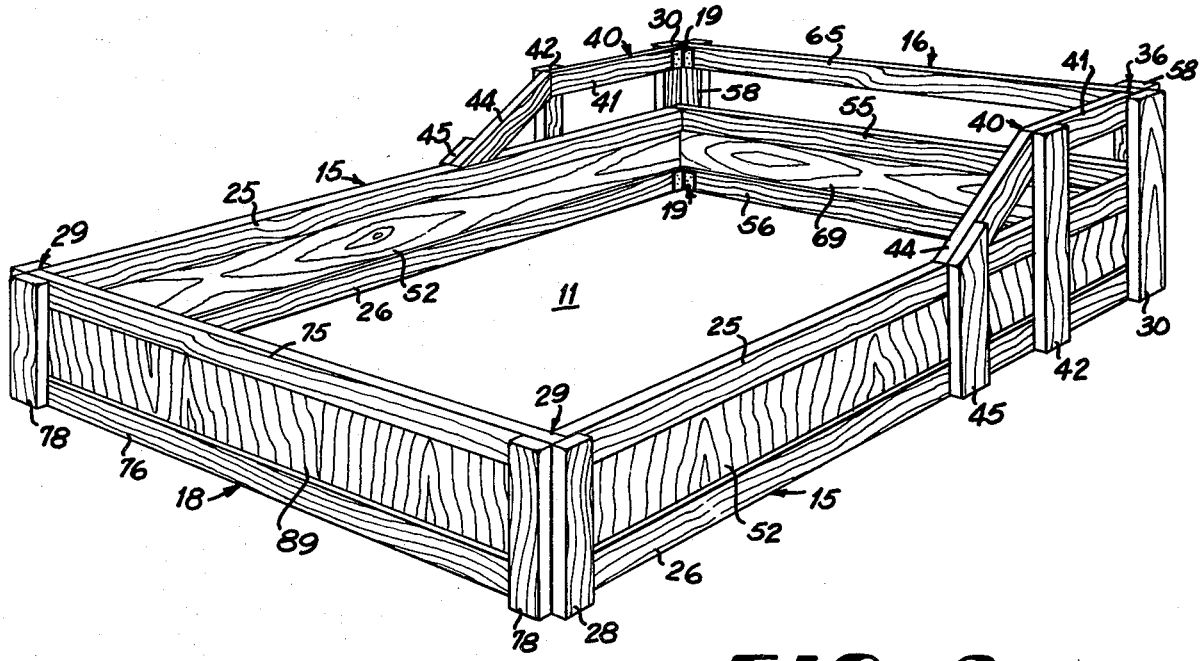
FIG. 2 is a perspective view of the bed frame assembly.
Figure 3:
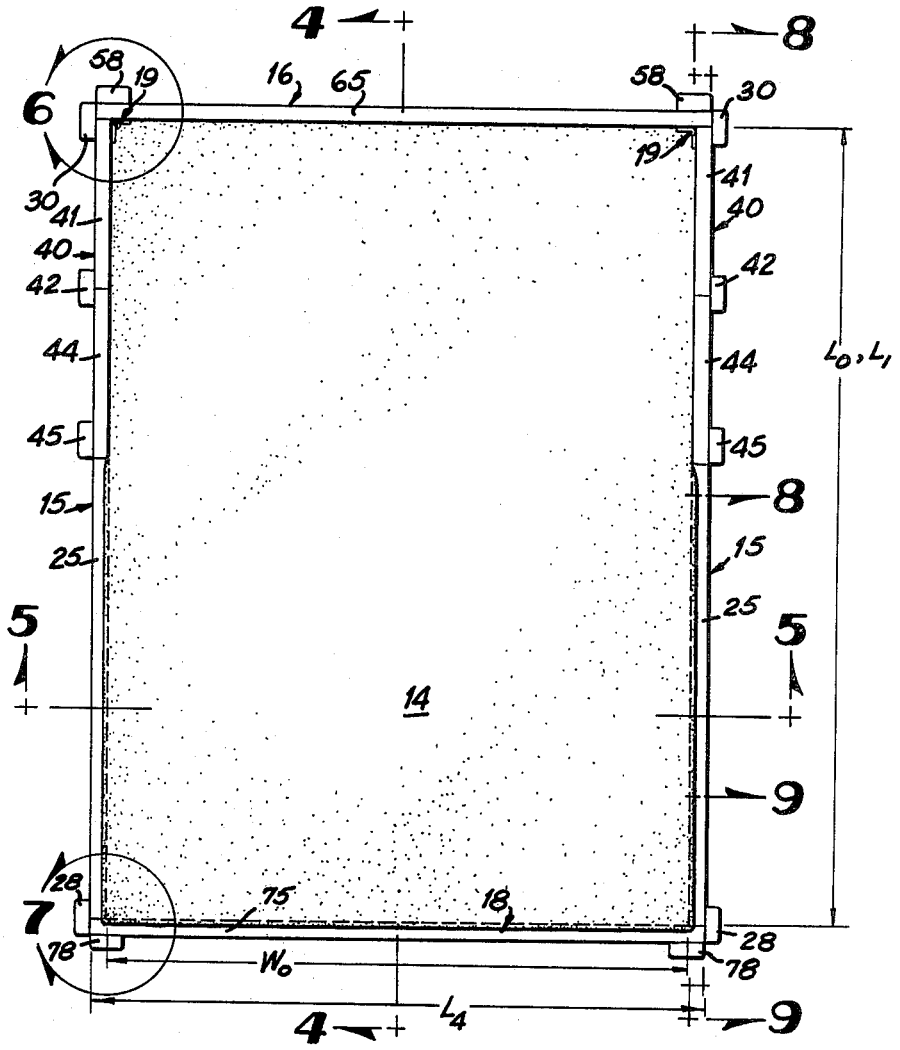
FIG. 3 is a top plan view of the bed.

Referring to the figures, it will be seen that the bed construction includes generally a bed frame assembly adapted to rest on a generally horizontal floor surface and defining a generally vertically extending mattress receiving opening 11 therethrough which extends to the floor surface as seen in FIG. 2. A foundation 12 (FIGS. 4 and 5) is received in the mattress receiving opening 11 in the bed frame assembly and is supported on the floor surface. A mattress 14 (FIGS. 1 and 3–5) is also received in the mattress receiving opening 11 in the bed frame assembly and is supported on top of the foundation 12. It will thus be seen that the foundation 12 and mattress 14 are vertically supported on the floor surface while the bed frame assembly confines the foundation 12 and mattress 14 laterally to keep them in place.

The bed frame assembly includes a pair of side frame subassemblies 15, a head frame subassembly 16, and a foot frame subassembly 18. The head frame subassembly 16 and foot frame subassembly 18 connect opposite ends of the side frame subassemblies 15 to define the mattress receiving opening 11 therebetween. The side frame subassemblies 15 are removably connected to the head frame subassembly 16 and foot frame subassembly 18 by attachment mechanisms 19.

Figure 8:
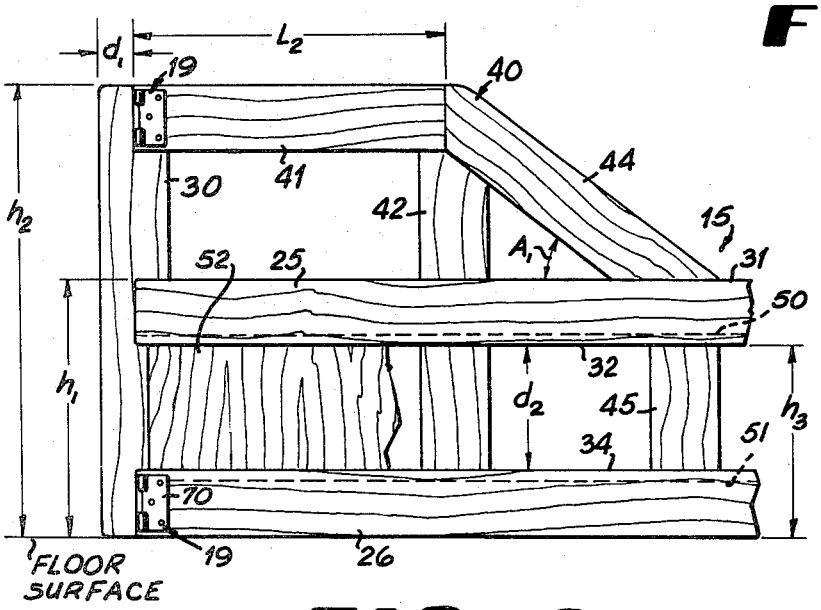
FIG. 8 is a view taken generally along line 8—8 in FIG. 3 with the foundation and mattress omitted.
Figure 9:
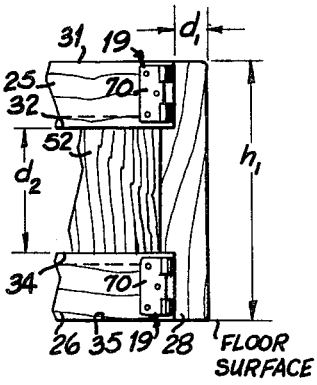
FIG. 9 is a view taken generally along line 9—9 in FIG. 3 with the foundation and mattress omitted.

Each of the side frame subassemblies 15 includes a horizontally extending lower primary side member 26 of length $L_1$ and a horizontally extending upper primary side member 25 also of length $L_1$ parallel to and spaced above the lower side member 26 so that the upper and lower side members 25 and 26 are in vertical registration. The lower side member 26 lays on the floor surface. A vertically extending foot support post 28 overlaps the outside of those ends of the upper and lower side members 25 and 26 at the foot end 29 of side subassembly 15 and is fixedly connected thereto by conventional means such as screws (not shown). It will be seen that the foot support post 28 is positioned so that it projects beyond the ends of the side members 25 and 26 a distance $d_1$ as best seen in FIG. 9 to overlap the foot frame subassembly 18 as will become more apparent. The lower edge 35 of the lower side member 26 is flush with the bottom of post 28 as seen in FIG. 9 and the upper edge 31 of the upper side member 25 is flush with the top of post 28. The post 28 has a height $h_1$ as will become more apparent. A vertically extending head support post 30 overlaps the outside of those ends of the upper and lower side members 25 and 26 at the head end 36 of side frame subassembly 15 and is fixedly connected thereto similarly to foot post 28. The lower edge 35 of the lower side member 26 is flush with the bottom of post 30 while the upper edge 31 of upper side member 25 is located intermediate the top and bottom of post 30 at height $h_1$ as seen in FIG. 8. The head post 30 has a height $h_2$ greater than the height $h_1$ and thus extends above the upper side member 25. The post 30 is positioned so that it projects beyond the ends of side members 25 and 26 the distance $d_1$ like post 28. It will thus be seen that the upper edge 31 of the upper side member 25 is located at the height $h_1$ above the floor when the lower edge 35 of the lower side member 26 is resting on the floor and that the lower edge 32 of the upper side member 25 is located a constant distance $d_2$ above the upper edge 34 of the lower side member 26. This locates the lower edge 32 on the upper side member 25 at a height $h_3$ above the floor surface.

Each of the side frame subassemblies 15 also includes an arm assembly 40 best seen in FIG. 8 adjacent the head end 36 of the subassembly 15. The arm assembly 15 includes a horizontally extending arm member 41 positioned above and parallel to the side members 25 and 26. The upper end of the head post 30 overlaps the outside of that end of the arm member 41 at the head end 36 of side frame subassembly 15 and is attached thereto so that the head post 30 projects beyond the end of arm member 41 the distance $d_1$. The top edge of the arm member 41 is flush with the top of head post 30. The arm member 41 extends from head post 30 toward the foot end of assembly 15 with a length $L_2$ about one-fourth length $L_1$. That end of the arm member 41 facing the foot end of assembly 15 is supported by the upper end of vertical intermediae arm support post 42 also of height $h_2$ which overlaps the outside of that end of arm member 41. The post 42 is also attached to side members 25 and 26 and extends to the floor like post 30. An angled arm member 44 extends between the foot facing end of arm member 41 and the upper edge 31 of upper side member 25 at an included angle $A_1$ shown at about 45°. A vertical front arm post 45 extends from the floor up to and is connected to that end of angled arm member 44 at the upper edge 31 of side member 25. The top of post 45 is cut at an angle to match that of angled arm member 44 as best seen in FIG. 2.

Figure 5:
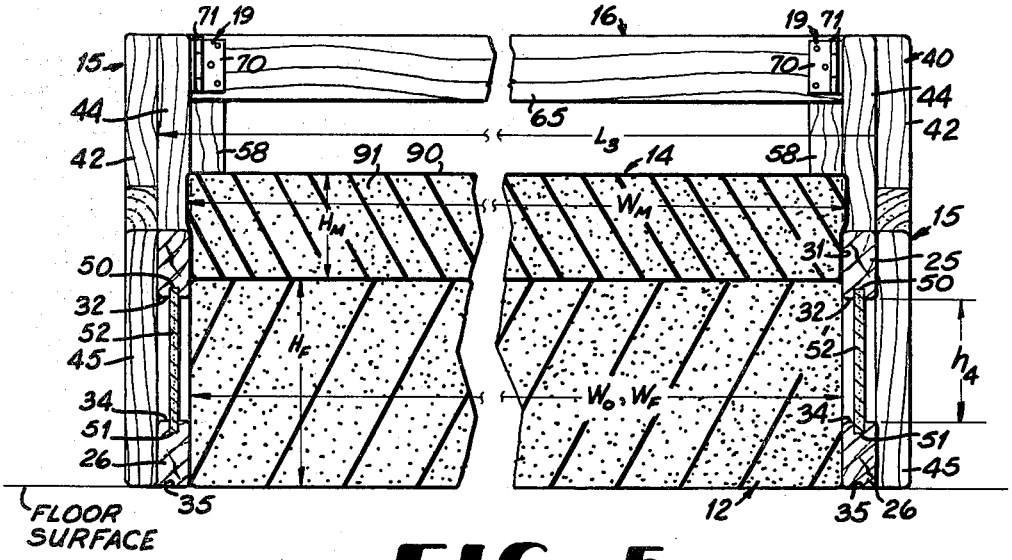
FIG. 5 is a transverse cross-sectional view taken generally along line 5—5 in FIG. 3.

The upper primary side member 25 defines a longitudinally extending groove 50 along the length thereof as seen in FIGS. 5, 8 and 9 which opens onto the lower edge 32 thereof. The lower primary side member 26 defines a similar longitudinally extending groove 51 along the length thereof which opens onto the upper edge 34 thereof so that the grooves 50 and 51 are directly opposed to each other. A decorative insert is slidably received in grooves 50 and 51. The insert 52 has a height $h_4$ greater than the distance $d_2$ between the upper and lower primary side members 25 and 26 so that the insert 52 will be retained in the grooves 50 and 51. The insert 52 has a length substantially equal to the length of the upper and lower primary side members 25 and 26 or some length so that one or more of the inserts 52 can be used to fill the space between the upper and lower primary side members 25 and 26 as illustrated in FIGS. 1 and 2. The inserts 52 are illustrated as being made of a contrasting wood to the side members 25 and 26; however, it is to be understood that the inserts 52 may be mirrors, fabric, wicker or any other material to change the external decor of the bed frame assembly. Thus, if the owner changes the decor of a room, he only has to select an insert 52 which best complements the room decor and swap the inserts.

Figure 4:
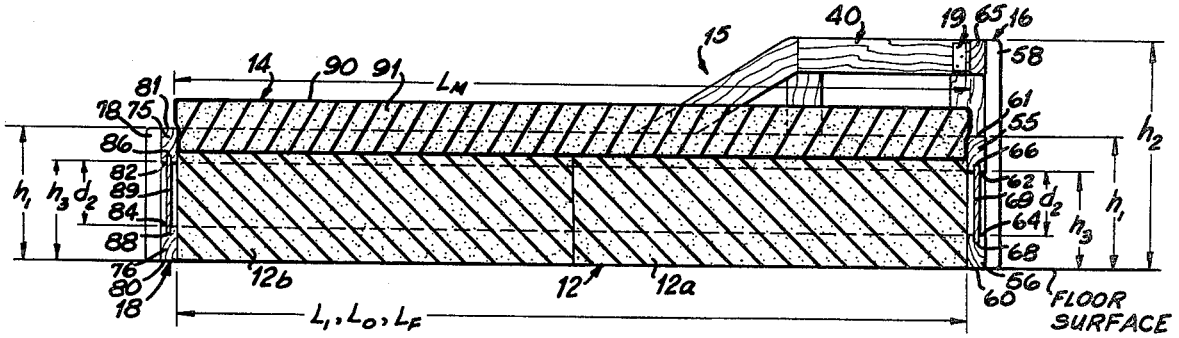
FIG. 4 is a longitudinal cross-sectional view taken generally along line 4—4 in FIG. 3.
Figure 6:
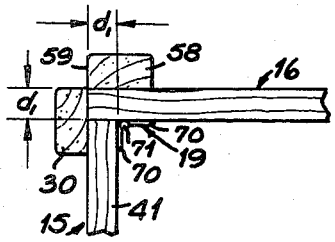
FIG. 6 is an enlarged view taken generally along line 6 in FIG. 3 with the foundation and mattress omitted.

The head frame subassembly 16 includes a horizontally extending lower primary head end member 56 and a horizontally extending upper primary head end member 55 parallel to and spaced above the lower end member 56 so that the upper and lower end members 55 and 56 are in vertical registration. The lower end member 56 lays on the floor surface as seen in FIG. 4. A vertically extending head end support post 58 connects the upper and lower end members 55 and 56 at their opposite ends. Each of the end support posts 58 is fixedly connected to the end members 55 and 56 by conventional means, such as screws (not shown). It will be seen that the end support posts 58 are positioned so that the outboard edge 59 of each of the support posts 58 is flush with the ends of end members 55 and 56 as best seen in FIG. 6. The end support posts 58 each have a height $h_2$ corresponding to that of the head support posts 30 on the side frame subassembly 15. It will also be seen that the lower edge 60 of the lower primary end member 56 is flush with the bottom of the posts 58 while the upper edge 61 of the upper primary end member 55 is located intermediate the top and bottom of the posts 58 at a height $h_1$ corresponding to that of the side members 25 of the side frame subassembly 15. The lower edge 62 of the upper end member 55 is located the constant distance $d_2$ above the upper edge 64 of the lower end member 56. Like the side frame subassembly 15, this locates the lower edge 62 of the upper end member 55 at a height $h_3$ above the floor surface as best seen in FIG. 4.

The head frame subassembly 16 also includes a top end member 65 which extends between and is connected to the end support posts 58 with its opposite ends being flush with the outboard edges 59 on the posts 58. The top edge of the top end member 65 is flush with the tops of the posts 58 so that the top edge of the top end member 65 is located a height $h_2$ above the floor. The upper and lower primary end members 55 and 56 as well as the top end member 65 all have a length $L_3$ as best seen in FIG. 5.

The upper primary end member 55 defines a longitudinally extending groove 66 along the length thereof as seen in FIG. 4 which opens onto the lower edge 62 thereof. The lower primary end member 56 defines a similar longitudinally extending groove 68 along the length thereof which opens onto the upper edge 64 thereof so that the grooves 66 and 68 are directly opposed to each other. A decorative insert 69 similar to insert 52 is slidably received in grooves 66 and 68 between the end members 55 and 56. The insert 69 has a height similar to that of insert 52 and a length which is substantialy equal to the length of the upper and lower primary end members 55 and 56 or some shorter length so that a plurality of the inserts 69 can be used to fill the space between the upper and lower primary end members 55 and 56 as described for the side frame subassemblies 15.

The attachment mechanisms 19 which connect the side frame subassembly 15 with the head frame subassembly 16 are best seen in FIGS. 5 and 6. It will be seen that the attachment mechanisms 19 are illustrated as butt-type hinges which have a pair of attachment plates 70 that are pivotally connected by a hinge pin 71. The attachment mechanisms 19 are used to connect opposite ends of the top end members 65 with those ends of the horizontal arm member 41 at the head end 36 of the side frame subassemblies 15. The attachment members 19 are also used to connect opposite ends of the lower primary end member 56 with those ends of the lower primary side members 26 at the head end 36 of the side frame subassembly 15. The attachment plates 70 connected to the ends of the arm member 41 and the lower side members 26 on the side frame subassemblies 15 are arranged so that the pinned connection is substantially flush with the ends of these members. The attachment plates 70 connected to the top end member 65 andthe lower primary end member 56 on the head frame subassembly 16 are attached at a position spaced away from the end of the members 56 and 65 by the distance $d_1$ as seen in FIG. 6 so that when the hinge pins 71 connect the attachment plates 70, the ends of the top end member 65 on the head frame subassembly 16 will overlap the ends of the horizontal arm members 41 on the side frame subassemblies 15 while the ends of the upper and lower primary head end members 55 and 56 respectively overlap the ends of upper and lower primary side members 25 and 26 on the side frame subassemblies 15. The ends of the top member 65 as well as the upper and lower end members 55 and 56 of the head frame subassembly 16 abut the inside of those portions of the head support posts 30 on side frame subassemblies 15 projecting past the ends of the side members 25 and 26 and the arm member 41. This serves to cover the ends of the top member 65 and end members 55 and 56 and also to keep the side frame subassemblies 15 perpendicular to the head frame subassembly 16. In this manner, it will be seen that none of the ends of the side members 25 and 26, the end members 55 and 56, the arm member 41 or the top end member 65 will be exposed. It will further be noted that the attachment mechanisms 19 can be separated by removing the pins 71 connecting the attachment plates 70.

The decorative inserts 52 in the side frame subassemblies 15 will be retained in place at the head end 36 by the upper and lower primary head end members 55 and 56 while the inserts 69 in the primary end members 55 and 56 will be retained therein by the head posts 30 on the side frame subassemblies 15. When the attachment mechanisms 19 are disconnected, the inserts can be replaced.

Figure 7:
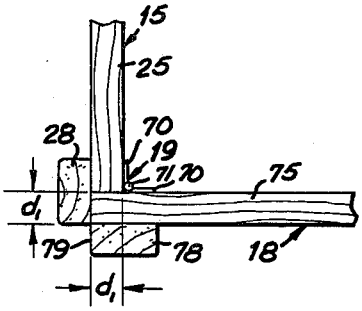
FIG. 7 is an enlarged view taken generally along line 7 in FIG. 3 with the foundation and mattress omitted.

The foot frame subassembly 18 includes a horizontally extending lower primary foot end member 75 and a horizontally extending upper primary foot end member 75 parallel to and spaced above the lower end member 76 so that the upper and lower end members 75 and 76 are in vertical registration. The lower end member 76 lays on the floor surface as seen in FIG. 4 and the end members 75 and 76 both have a length $L_4$. A vertically extending foot end support post 78 connects the upper and lower end members 75 and 76 at their opposite ends. Each of the end support posts 78 is fixedly connected to the end members 55 and 56 by conventional means, such as screws (not shown). It will be seen that the end support posts 78 are positioned so that the outboard edge 79 of each of the support posts 58 is flush with the ends of end members 75 and 76 as best seen in FIG. 7. The end support posts 78 each have a height $h_1$ corresponding to that of the foot support posts 28 on the side frame subassembly 15. It will also be seen that the lower edge 80 of the lower primary end member 76 is flush with the bottom of the posts 78 while the upper edge 81 of the upper primary end member 75 is flush with the tops of the posts 78. The lower edge 82 of the upper end member 75 is located the constant distance $d_2$ above the upper edge 84 of the lower end member 76. Like the side frame subassembly 15, this locates the lower edge 82 of the upper end member 75 at a height $h_3$ above the floor surface as best seen in FIG. 4.

The upper primary end member 75 in foot frame subassembly 18 defines a longitudinally extending groove 86 along the length thereof as seen in FIG. 4 which opens onto the lower edge 82 thereof. The lower primary end member 76 defines a similar longitudinally extending groove 88 along the length thereof which opens onto the upper edge 84 thereof so that the grooves 86 and 88 are directly opposed to each other. A decorative insert 89 similar to inserts 52 and 69 is slidably received in grooves 86 and 88 between the end members 75 and 76. The insert 89 has a height similar to that of inserts 52 and 69 and a length which is substantially equal to the length of the upper and lower primary end members 75 and 76 or some shorter length so that a plurality of the inserts 89 can be used to fill the space between the upper and lower primary end members 75 and 76 as described for the side frame subassemblies 15.

The attachment mechanisms 19 connect the opposite ends of the lower primary foot end member 75 on the foot frame subassembly 18 with the ends of the lower primary side members 26 on the side frame subassemblies 15 at the foot end 29 and the opposite ends of the upper primary foot end member 76 with the ends of the upper primary side members 26 at the foot end 29 of side frame subassemblies 15. The attachment plates 70 of mechanisms 19 are connected to the ends of the upper and lower side members 25 and 26 on the side frame subassemblies 15 so that the pinned connection is substantially flush with the ends of these members. The attachment plates 70 connected to the upper primary end member 75 and the lower primary end member 76 on the foot frame subassembly 18 are attached at a position spaced away from the end of the members 75 and 76 by the distance $d_1$ as seen in FIG. 7 so that when the hinge pins 71 connect the attachment plates 70, the ends of the upper primary foot end member 75 on the foot frame subassembly 18 will overlap the ends of the upper primary side members 25 on the side frame subassemblies 15 while the ends of the lower primary foot end member 76 overlaps the ends of the lower primary side member 26 on the side frame subassemblies 15. The upper and lowr end members 75 and 76 of the foot frame subassembly 18 abut the inside of those portions of the support posts 28 on side frame subassemblies 15 projecting past the ends of the side members 25 and 26. This serves to cover the ends of end members 75 and 76 and also to keep the side frame subassemblies 15 perpendicular to the foot frame subassembly 16. In this manner, it will be seen that none of the ends of the side members 25 and 26 or the end members 75 and 76 will be exposed. It will further be noted that the attachment mechanisms 19 can be separated by removing the pins 71 connecting the attachment plates 70.

The decorative inserts 52 in the side frame subassemblies 15 will be retained in place at the foot end 29 by the upper and lower primary foot end members 75 and 76 while the inserts 89 in the primary end members 75 and 76 will be retained therein by the foot posts 28 on the side frame subassemblies 15. When the attachment mechanisms 19 are disconnected, the inserts can be replaced.

The foundation 12 is best seen in FIGS. 4 and 5. While foundation 12 can have different constructions, it is illustrated as being made out of a foamed elastomeric material such as polyurethane. The foamed elastomeric material should have a sufficient density and resiliency to adequately support the mattress 14 as well as persons sleeping thereon. A foamed elastomeric material commercially available as No. 1236 foam with a density of 1.2 lb./ft.$^3$ and a standard compression rating of 3.6 pounds has been found satisfactory, although other ratings can be used.

The foundation 12 is illustrated in two sections $12_a$ and $12_b$ of like size. The foundation 12 has a width $W_F$ seen in FIG. 5 substantially equal to the opening width $W_o$ and a total length $L_F$ as seen in FIG. 4 substantially equal to the opening length $L_o$. Each foundation section $12_a$ and $12_b$ has an uncompressed height $H_F$ seen in FIG. 5 greater than the height $h_3$ of the lower edges of the upper side members 25, upper head end member 55 and upper foot end member 80 but less than the height $h_1$ of the upper edges of these members. Thus, it will be seen that the top portion of the foundation 12 is laterally confined by the upper side members 25 of the side frame subassemblies 15, the upper head end member 55 of the head frame subassembly 16 and the upper foot end member 80 of the foot frame subassembly 18 while the bottom portion of the foundation 12 is laterally confined by the lower side members 26 of the side frame subassemblies 15, the lower head end member 56 of the head frame subassembly 16, and the lower foot end member 81 of the foot frame subassembly 18. This serves to keep the foundation stable laterally.

The mattress 14 is also best seen in FIGS. 4 and 5 with a cover 90 over the mattress body 91. The mattress 14 may have different constructions, however, it is illustrated with the mattress body 91 made out of a foamed elastomeric material such as polyurethane. The particular density and compression rating of the foamed elastomeric material is selected to give the desired sleeping characteristics for the user. A foamed elastomeric material commercially available as No. 2030 foam with a density of 2.0 lbs./ft.$^3$ and a standard compression rating of 3.0 pounds has been found satisfactory to produce medium sleeping characteristics in mattress 14. A No. 2020 foam with a compression rating of 2.0 pounds has been found satisfactory for soft sleeping characteristics, and a No. 2036 foam with a compression rating of 3.6 pounds has been found satisfactory for firm sleeping characteristics.

The mattress 14 has an uncompressed width $W_M$ in FIG. 5 slightly greater than the width $W_o$ of the opening 11 and an uncompressed length $L_M$ in FIG. 4 slightly greater than the length $L_o$ of the opening 11 so that the mattress 14 will be slightly compressed around its edges as it is forced down into the mattress receiving opening 11 as best seen in FIGS. 4 and 5. This serves two functions, to retain the mattress 14 within opening 11 and to laterally confine the mattress 14 on top of the foundation 12. While different widths and lengths may be selected for mattress 14, having the mattress about an inch wider and about an inch longer than opening 11 has worked satisfactorily. The mattress 14 has an uncompressed height $H_M$ seen in FIG. 5 greater than the difference between the height $h_1$ of frame assembly 10 and height $H_F$ of foundation 12 so that the mattress 14 projects upwardly out of the opening 11 above the top edges 31, 61 and 81 of the respective members 25, 55 and 75 forming the top of the opening 11. This serves to prevent the user from inadvertently coming in contact with the bed frame assembly 12 while using the bed. While different heights $H_M$ may be used, one where the mattress 14 projects upwardly out of the opening 11 for about three inches has been found satisfactory.

While different materials may be used for the various members in the side frame subassemblies 15, head frame subassembly 16 and foot frame subassembly 18, they are illustrated as being made out of wood. The cross-sectional size of the various members of the subassemblies 15, 16 and 18 may be different; however, they are illustrated as having the same size with about a two inch by four inch cross-section. The decorative inserts 52, 69 and 89 are illustrated as being about the same size so that they are interchangeable.

I claim:

1. A bed construction adapted to be supported on a generally horizontal floor surface comprising:

a frame assembly defining a generally vertically extending open top mattress receiving opening therethrough having a prescribed opening length and a prescribed opening width so that, when said frame assembly is supported on the floor surface, said mattress receiving opening extends from the floor surface through said frame assembly to a prescribed opening height at the open top thereof;

a resilient foundation having a size and shape complementary to the size and shape of said mattress receiving opening removably received in said mattress receiving opening in said frame and supported on the floor surface, said frame assembly confining said foundation against movement in all directions parallel to the floor surface to maintain said foundation in position on the floor and said foundation having a foundation height less than said prescribed opening height so that, when said foundation is positioned within said mattress receiving opening and supported on the floor surface, the top of said foundation lies below the open top of said mattress receiving opening; and a resilient mattress having a size and shape complementary to the size and shape of said mattress receiving opening with a prescribed mattress length greater than said prescribed opening length and a prescribed mattress width greater than said prescribed opening width such that said mattress can be forced into said mattress receiving opening by compressing said mattress so that said mattress is positively restrained against lateral movement by said frame assembly while being removably received in said mattress receiving opening in said frame assembly on top of and supported on said foundation so that a person is resiliently supported on top of said mattress by the combined resiliency of said mattress and said foundation, said frame assembly confining said mattress against movement in all directions parallel to the floor surface to maintain said mattress in position on top of said foundation and said mattress having a mattress height greater than the difference between said foundation height and said opening height so that, when said mattress is positioned on top of said foundation within said mattress receiving opening, said mattress projects above the top of said mattress receiving opening.

2. The bed construction of claim 1 wherein said frame assembly includes a pair of spaced apart, generally parallel, side frame subassemblies, a head frame subassembly connecting said side frame subassemblies at one end thereof, and a foot frame subassembly connecting said side frame subassemblies at the opposite end thereof, said frame subassemblies defining said mattress receiving opening therebetween and each of said frame assemblies including an upper member defining the top of said mattress receiving opening, each of said upper members having an upper edge positioned at said prescribed opening height above the floor surface and a lower edge positioned at a prescribed lower edge height above the floor surface; and wherein said prescribed foundation height is greater than said prescribed lower edge height and less than said prescribed opening height.

3. The bed construction of claim 2 wherein said foundation is made out of a first foamed elastomeric material and wherein said mattress is made out of a second foamed elastomeric material.

4. The bed construction of claim 3 wherein said first foamed elastomeric material is less resilient than said second foamed elastomeric material.

5. A bed construction adapted to be supported on a generally horizontal floor surface comprising:

a frame assembly including a pair of side frame subassemblies, a head frame subassembly, a foot frame subassembly, and attachment means for fixedly yet removably connecting said head frame subassembly to said side frame subassemblies at one end thereof and for fixedly yet removably connecting said foot frame subassembly to said side frame subassemblies at the opposite end thereof so that said side frame subassemblies are parallel to each other, and said head and foot frame subassemblies are parallel to each other with said side frame subassemblies perpendicular to said head and foot frame subassemblies, said frame subassemblies adapted to be supported on the floor surface and extend vertically upward therefrom, said frame subassemblies defining a generally vertically extending rectilinear opening therebetween having a prescribed width and length so that, when said frame assembly is supported on the floor surface, said mattress receiving opening extends through said frame assembly to the floor surface, each of said frame subassemblies comprising a lower member adapted to rest on the floor surface and an upper member spaced above said lower member and generally parallel thereto, each of said upper members having an upper edge parallel to and spaced above the floor surface a first prescribed distance and a lower edge parallel to and spaced above the floor surface a second prescribed distance less than said first prescribed distance;

a resilient foundation having a top and bottom and having a width and length complementary to the width and length of said rectilinear opening removably received in said mattress receiving opening in said frame and supported on the floor surface, said foundation having a prescribed foundation height less than said first prescribed distance and greater than said second prescribed distance so that, when said foundation is positioned in said rectilinear opening and supported on the floor surface, the top of said foundation lies between said upper and lower edges of said upper members of said frame subassemblies so that said upper members confine said foundation adjacent said top and said lower members confine said foundation adjacent said bottom against movement in all directions parallel to the floor surface to maintain said foundation in position on the floor surface; and a resilient mattress having a prescribed length greater than the length of said rectilinear opening, a prescribed width greater than the width of said rectilinear opening, and a prescribed height greater than the distance said top of said foundation is spaced below said upper edges of said upper members so that when said mattress is received in said rectilinear opening and supported on top of said foundation, said mattress projects above said upper edge of said upper members and said upper members compress said mattress to retain said mattress in said rectilinear opening and confine said mattress against movement in directions parallel to the floor surface.

6. The bed construction of claim 5 wherein each of said side frame subassemblies further includes a first upstanding post connecting one of the ends of said upper and lower members of said side frame subassembly and a second upstanding post connecting the other of the ends of said upper and lower members of said side frame subassembly, said first and second posts extending past the ends of said upper and lower members of said side frame subassembly to respectively engage the end of said head frame subassembly and the end of said foot frame subassembly when said attachment means connects said frame subassemblies to maintain the relative positions of said frame subassemblies with respect to each other.

7. The bed construction of claim 5 wherein each of said frame subassemblies includes at least one decorative panel removably mounted between said lower and upper members and extending across the space between said lower and upper members in each of said frame subassemblies.

8. The bed construction of claim 7 wherein said upper member defines a downwardly opening groove in the lower edge thereof and wherein said lower member defines an upwardly opening groove in the upper edge thereof so that said grooves are in direct opposition to each other; and wherein said decorative panel is sized to be slidably inserted into said grooves to maintain said panel in place.

9. The bed construction of claim 8 wherein each of said frame subassemblies further includes a pair of support posts connecting opposite ends of said lower and upper members to maintain said lower and upper members in a spaced apart position.

* * * * *